US005304343A

United States Patent [19]

Miura et al.

[11] Patent Number: 5,304,343

[45] Date of Patent: Apr. 19, 1994

[54] ALUMINUM-ALLOY POWDER, SINTERED ALUMINUM-ALLOY, AND METHOD FOR PRODUCING THE SINTERED ALUMINUM-ALLOY

[75] Inventors: Shin Miura; Youichi Hirose; Yoshio Machida; Mitsuaki Sato, all of Saitama, Japan

[73] Assignee: Showa Denko K.K., Tokyo, Japan

[21] Appl. No.: 962,906

[22] Filed: Oct. 19, 1992

Related U.S. Application Data

[62] Division of Ser. No. 635,444, Dec. 28, 1990, Pat. No. 5,176,740.

[30] Foreign Application Priority Data

Dec. 29, 1989 [JP] Japan ..... 1-342931
Aug. 7, 1990 [JP] Japan ..... 2-207496

[51] Int. Cl.[5] ..... B22F 3/12

[52] U.S. Cl. ..... 419/39; 419/38; 419/45; 419/46; 419/47; 419/53; 419/57

[58] Field of Search ..... 419/26, 38, 39, 53, 419/60, 45, 46, 47, 57

[56] References Cited

U.S. PATENT DOCUMENTS

| | | | |
|---|---|---|---|
| 2,155,651 | 4/1939 | Goetzpl | 75/22 |
| 3,331,684 | 7/1967 | Storchheim | 75/208 |
| 3,359,095 | 12/1967 | Foerster et al. | 75/200 |
| 3,366,479 | 1/1968 | Storchheim et al. | 75/214 |
| 3,687,657 | 8/1972 | Storchheim | 75/212 |
| 3,871,877 | 3/1975 | Storchheim | 75/214 |
| 4,177,069 | 12/1979 | Kobayashi et al. | 75/213 |
| 4,435,213 | 3/1984 | Hildeman et al. | 75/249 |
| 4,460,541 | 7/1984 | Singleton et al. | 419/42 |
| 4,592,781 | 6/1986 | Cheney et al. | 75/249 |
| 4,702,885 | 10/1987 | Odani et al. | 419/23 |
| 4,722,751 | 2/1988 | Akechi et al. | 75/232 |
| 4,838,936 | 6/1989 | Akechi | 75/249 |
| 4,937,042 | 6/1990 | Perkins et al. | 419/8 |
| 4,943,319 | 7/1990 | Yanagawa et al. | 75/229 |
| 5,061,323 | 10/1991 | De Luccia | 148/11.5 |
| 5,067,994 | 11/1991 | Brubak et al. | 148/415 |

OTHER PUBLICATIONS

Hausner, Henry, "Handbook of PM", 1973, p. 83, 10, Chemical Publishing Co., Inc., NY, NY.

*Primary Examiner*—Donald P. Walsh
*Assistant Examiner*—Daniel Jenkins
*Attorney, Agent, or Firm*—Armstrong, Westerman, Hattori, McLeland & Naughton

[57] ABSTRACT

An aluminum-alloy main-starting powder for producing a sintered aluminum-alloy consists of from 0.1 to 3.0% of Cu, the balance being Al and unavoidable impurities. Mother alloy powder consists of from 4 to 20% of Mg, from 12 to 30% of Si, and Al and unavoidable impurities in balance.

18 Claims, No Drawings

ALUMINUM-ALLOY POWDER, SINTERED ALUMINUM-ALLOY, AND METHOD FOR PRODUCING THE SINTERED ALUMINUM-ALLOY

This is a division of application Ser. No. 07/635,444 filed Dec. 28, 1990, now U.S. Pat. No. 5,176,740.

BACKGROUND OF INVENTION

1. Field of Invention

The present invention relates to an aluminum-alloy starting powder for producing a sintered aluminum-alloy, a sintered aluminum-alloy, and a method for producing the sintered aluminum-alloy.

2. Description of Related Arts

Recently, demands for light aluminum-alloy parts are increasing in the field of office machines and computer-related machinery and equipment, because power consumption must be lessened, noise generation due to vibration must be prevented, and, further, portability of the machines must be improved.

One of the methods for producing the aluminum-alloy parts is the ordinary powder metallurgy method, which comprises pressing and sintering process. The products of the powder metallurgy are greatly advantageous over die castings and wrought products, in the fact that precise parts having near net shape and free of defects can be produced by a simple process.

The compositions of the sintered aluminum-alloy are usually similar to or belong to 2000 series or 6000 series of AA standard, which are heat treatable and hence can exhibit a high strength level (c.f. J. D. Generous and W. C. Montgomery, Chapter 8 "Aluminum P/M Properties and Applications" Powder Metallurgy, Edited by E. Klar, P211-234, and ASTM Designation: B595-84 Standard Specification for SINTERED ALUMINUM ALLOY STRUCTURAL PARTS).

The so-called blended elemental method is well known for producing the aluminum-alloy precision parts by the pressing and sintering process. The starting powder used in the blended elemental method is a mixture of pure Al powder and elemental powder of such alloying elements as Cu, Si, Mg, and the like which form a low-melting point eutectic with Al. However, the elemental powder has a high melting point, and, further, the means distance between the particles of the elemental powder is great in the green compact. Uniform diffusion of the elements and satisfactory formation of the eutectic occur with difficulty. In addition, the alloying elements may remain unalloyed in the sintered product. The blended elemental method therefore results in a sintered aluminum-alloy with a high strength being produced with difficulty.

There is a pre-alloy method for producing aluminum-alloy precision parts by the pressing and sintering process. According to this method, one or more alloying elements is preliminarily added to the Al powder so as to provide the starting powder having the final composition, i.e., the composition of the sintered product. In this method, the alloying element(s) so hardens the starting powder that it is difficult to shape the starting powder by pressing. A green compact therefore has very low density. In addition, since the alloying element(s) lowers the melting point of the starting powder, it therefore becomes difficult to enhance the sintering temperature so as to cause satisfactory diffusion and sintering. Furthermore, since the melting point of all the particles of the starting powder is identical, the liquid phase is not formed in the proper amount but is formed either excessively or very low.

There is a master-alloy method for producing the aluminum-alloy precision parts by the pressing and sintering process (c.f. for example Japanese Unexamined Patent Publication No. 1-294833). According to this method, one or more alloying elements is added to Al powder to prepare the master-alloy. The master-alloy is mixed with pure Al powder to prepare a starting-mixture powder. The composition of the master-alloy is so adjusted that a multi-system eutectic having a low melting point is easily formed during the sintering.

There are demands for a method for producing a sintered aluminum-alloy having a high strength and elongation.

When sintered parts having a complicated shape is produced by the conventional methods, they exhibit poor mechanical properties, particularly poor elongation. The mixture alloy-powder and pure aluminum-powder is difficult to uniformly density a green compact into a die and to uniformly shape by compressing. The sintered aluminum-alloy has therefore locally low density, which causes reduction in the mechanical strength of the sintered aluminum-alloy.

SUMMARY OF THE INVENTION

The present inventors devised a starting powder for producing the sintered aluminum-alloy, which powder can overcome the disadvantages as described above.

First, instead of pure Al-powder, which is used as the main starting material in the blended elemental method, an Al-Cu alloy powder with a small content of Cu additive is used.

Second, the present inventors aimed to improve the master-alloy method, and determined the composition and amount of the master-alloy so as to promote the sintering by forming the liquid phase, i.e., the liquid-phase sintering.

It is an object of the present invention to provide the main starting-powder which has good compactibility, and whose sintering temperature is sufficiently high.

It is another object of the present invention to provide a master-alloy powder, which can supply alloying elements to the sintered aluminum-alloy, and which has such a melting point that the liquid phase is formed at a sintering temperature suitable for promoting the diffusion of the alloying elements and for promoting the sintering.

It is a further object of the present invention to provide a blended starting powder for producing a sintered aluminum-alloy having a similar composition of 2000 or 6000 series AA standard alloy which powder can provide the sintered aluminum-alloy having improved mechanical properties.

It is also an object of the present invention to provide a sintered aluminum-alloy having a similar composition of 200 or 6000 series AA standard and having improved mechanical properties.

It is another object of the present invention to provide a method for producing a sintered aluminum alloy having a 2000 series or 6000 series composition of AA standard and having improved mechanical properties.

A main starting-powder according to the present invention consists of from 0.1 to 3.0% by weight of Cu, and Al and unavoidable impurities in balance. The percentages given hereinafter are expressed by weight.

This main starting-powder may further contain from 0.1 to 2.0% of at least one element selected from Mn, Ni, Fe, Cr, Zr, Ti, V, Pb, Bi, and Sn.

A master-alloy powder according to the present invention consists of from 4 to 20% of Mg, from 12 to 30% of Si, and Al and unavoidable impurities in balance. The master-alloy powder may further contain from 0.1 to 8% of at least one element selected from Mn, Ni, Fe, Cr, Zr, Ti, V, Pb, Bi, and Sn.

Another master-alloy powder according to the present invention consists of from 4 to 20% of Mg, from 12 to 30% of Si, from 1 to 30% of Cu, from 0.1 to 8% of at least one element selected from Mn, Ni, Fe, Cr, Zr, Ti, V, Pb, Bi, and Sn, and Al and unavoidable impurities in balance.

A further master-alloy according to the present invention consists of from 1 to 20% of Mg, from 1 to 20% of Si, from 30 to 50% of Cu, and Al and unavoidable impurities in balance. This master-alloy may further contain from 0.1 to 8% of at least one element selected from Mn, Ni, Fe, Cr, Zr, Ti, V, Pb, Bi, and Sn.

A mixed starting powder according to the present invention consists of a mixture of the main starting-powder, and one or more of the above mentioned master-alloy powders. The composition of the mixture is from 0.1 to 2.0% of Mg, from 0.1 to 2.0% of Si, from 0.2 to 6.0% of Cu, and Al and unavoidable impurities in balance.

Another mixed starting powder according to the present invention consists of a mixture of the main starting-powder, and the master-alloy powder, whose composition is from 4 to 20% of Mg, from 12 to 30% of Si, from 1 to 30% of Cu, and Al and unavoidable impurities in balance. This mixture has a composition of from 0.1 to 2.0% of Mg, from 0.1 to 2.0% of Si, from 0.2 to 6% of Cu, and Al and unavoidable impurities in balance.

The mixed, aluminum-alloy starting powder according to the present invention may further contain from 0.2 to 2% of a lubricant.

Sintered Aluminum Alloy

The composition of the sintered aluminum-alloy according to the present invention is first described. The alloying elements added in the sintered aluminum-alloy are Mg, Si, and Cu. The coexistence Mg and Si cause the precipitation hardening to enhance the strength of the sintered aluminum-alloy. Such enhancement is virtually not appreciable at the Mg and Si content of 0.1% each or less. On the other hand, when the Mg or Si content exceeds 2%, the Mg and/or Si addition becomes excessive so that the strength and elongation are impaired. Therefore the Mg content is from 0.1 to 2.0%, and the Si content is from 0.1 to 2.0%.

Cu also strengthens the sintered product due to precipitation hardening, as do Si and Mg. As is described in detail hereinbelow, Cu is contained in the main starting-powder in an amount of from 0.2 to 3%. The minimum Cu content of the sintered alloy is therefore 0.2%. Below this Cu content, the sintering property of the alloy is poor. On the other hand, when the Cu content exceeds 6%, the Cu is likely to remain unresolved in the form of a coarse compound, with the result that strength and elongation are impaired. The Cu content is therefore from 0.2 to 6.0%.

The inventive sintered aluminum-alloy contains Mg, Si, and Cu within the ranges as described above. The Mg, Si, and Cu contents are adjusted within the ranges so as to provide two types of alloys having characterizing properties.

One of the alloys is characterized by strength and elongation, which are improved and well balanced, as well as improved corrosion-resistance. In order to attain such properties, the alloy composition is adjusted so that the fundamental elements are Al-Mg-Si, and, further, a relatively small amount of an additive is added to these elements; i.e., Cu is added in an amount of from 0.1 to 1%. This alloy is hereinafter referred to as "A alloy". A alloy has a composition which is similar to the 6000 series aluminum-alloy of AA standard. A alloy contains, however, Si slightly in excess of the amount of Mg, as compared with the case of the 6000-series wrought material. Improved mechanical properties are stably obtained as a result of the excessive Si. The composition of A alloy is from 0.1 to 1.0% of Mg, from 0.5 to 1.5% of Si, and from 0.1 to 1.0% of Cu, Al being in balance. A alloy contains preferably from 0.3 to 0.7% of Mg, from 0.8 to 1.2% of Si, and from 0.3 to 0.7% of Cu, Al being in balance. Main applications of A alloy are precision parts, such as a drive pulley and spacers, of electronics appliances and OA (office automation) appliances.

The other alloy is characterised by a high strength and hence contains a large amount of Cu, that is, from 2 to 6% of Cu. This alloy is an Al-Cu alloy and is similar to the 2000 series alloy of AA standard. This alloy is hereinafter referred to as "B alloy". The composition of B alloy is from 0.1 to 2.0% of Mg, from 0.1 to 2.0% of Si, and from 2 to 6% of Cu, Al being in balance. B alloy contains preferably from 0.1 to 0.8% of Mg, from 0.1 to 1.5% of Si, and from 2 to 6% of Cu, Al being in balance. Main applications of B alloy are precision parts of ordinary industrial machines which require a high level of strength, such as a connecting rod.

The starting-powder for producing a sintered aluminum-alloy according to the present invention is a mixture of two or more kinds of powder. The main starting-powder is that which is in the greatest amount in the starting powder. At least one of the powders is the master-alloy powder. The main starting powder is next described.

Main Starting-Powder

In a conventional method the pure-Al powder is mixed with powder of alloying element(s). The pure-Al powder satisfies only good compactibility and a high sintering temperature but does not satisfy good sintering property. The inventive main starting-powder, which contains a small content of Cu, satisfies all of these three properties. The sintered aluminum-alloy produced by using the inventive main starting-powder exhibits therefore considerably improved mechanical properties. When the Cu content in the main starting powder is less than 0.1%, an improvement in the sintering property is not very appreciable. On the other hand, when the Cu content exceeds 3.0%, not only has improvement in the sintering property reached its maximum, but also the main starting-powder is so hardened that its compactibility is impaired, and hence the density of a green compact is lessened. In addition, the melting point of the main starting-powder is so lowered that it becomes difficult to satisfactorily enhance the sintering temperature. In this case, sintering and diffusion do not occur uniformly and thoroughly. The Cu content of the main starting-powder is therefore from 0.1 to 3.0%.

Cu is fed to the sintered aluminum-alloy from the main starting-powder and from the master-alloy powder. The composition and mixing amount of the master-alloy are therefore adjusted to supply any deficient amount of Cu not supplied from the main starting-powder. This eliminates limitation in designing the composition and mixing amount of the master-alloy powder, in the case of the total amount of Cu being supplied from the master-alloy powder.

The other main starting-powder according to the present invention consists of from 0.1 to 3.0% by weight of Cu, from 0.1 to 2.0% by weight of at least one element selected from Mn, Ni, Fe, Cr, Zr, Ti, V, Pb, Bi, and Sn, and Al and unavoidable impurities in balance. This main starting-powder is used for producing a sintered aluminum-alloy which contains, in addition to Mg, Si, and Cu, 0.4% or less in total of Mn, Ni, Fe, Cr, Zr, Ti, V, Pb, Bi, and/or Sn. Mn, Ni, Fe, Cr, Zr, Ti, and V enhance the strength, while Bi and Sn enhance machinability.

The master-alloy powder is hereinafter described.

Master-Alloy Powder

The role of the master-alloy powder is: supplying Mg, Si, and Cu which contribute to the enhancement of strength of the sintered aluminum-alloy; melting by itself below the sintering temperature; and, making an eutectic reaction between itself and the main starting-powder, hence forming the liquid phase which promotes the sintering. The composition of the master-alloy powder is Al-Mg-Si or Al-Mg-Si-Cu. Since the master-alloy powder is hard, the compactibility of the powder mixture is impaired when the amount of the master-alloy powder mixed is great. The master-alloy powder is therefore desirably highly alloyed so as to supply the required amount of alloying elements in a small amount of the master-alloy powder. It is important, in deciding the composition of the master-alloy, to be able to produce it by an air-atomizing method, which is an economic method of producing the aluminum-alloy powder.

The lower limit of the alloying elements of the ternary Al-Mg-Si alloy is limited to 4% of Mg and 12% of Si, which is approximately the eutectic composition of said ternary alloy. Such a lower limit is determined considering high alloying and production by air-atomizing. When the Mg content exceeds 20%, the melt of the master-alloy becomes highly active, incurring the danger of an oxidizing explosion. Also the production of powder by air-atomizing becomes difficult. When the Si content exceeds 30%, since the liquidus temperature is enhanced and hence the final temperature of melting is enhanced, melting and atomizing of the master-alloy becomes difficult. In addition, when the Si content exceeds 30%, the formation of liquid phase due to the eutectic reaction during sintering, becomes difficult. The composition of the master-alloy powder is therefore from 4 to 20% of Mg, from 12 to 30% of Si, and Al and unavoidable impurities in balance, and is more preferably from 5 to 15% of Mg, from 15 to 25% of Si, and Al and unavoidable impurities in balance.

Cu can be added to the master-alloy powder having the above composition to provide an Al-Cu-Mg-Si master-alloy powder. In other words, since Cu is fed to the powder mixture from the main starting-powder, Cu need not be added to the master-alloy powder depending upon the composition of a sintered aluminum-alloy. The Cu added further lowers the solidus temperature, where melting of the alloy initiates. It is therefore possible to adjust the solidus temperature by adjusting the Cu content. Cu promotes therefore the sintering, thereby enhancing the mechanical properties. Since Cu is an age-hardening element and promotes the sintering, both the age-hardening and high density of a sintered product enhance the mechanical properties.

There are two compositions of the Al-Cu-Mg-Si alloy. One of them is appropriate for producing A alloy, while the other is appropriate for producing B alloy. Since the Cu content is becomes high also, then the mechanical properties are enhanced but the corrosion resistance is impaired.

An appropriate Cu content of the master-alloy is 30% or less. The composition of the master-alloy powder for producing A alloy is, therefore, from 4 to 20% of Mg, from 12 to 30% of Si, from 1 to 30% of Cu and Al and unavoidable impurities in balance, and is more preferably from 5 to 15% of Mg, from 15 to 25% of Si, from 5 to 15% of Cu, and Al and unavoidable impurities in balance.

In the case of B alloy, since the Cu content of B alloy is high so as to attain a high strength, the master-alloy powder must contain a high amount of Cu, i.e., at least 30%. If the Cu content of the master-alloy powder is 50% or more, its melting and atomizing operations become difficult. Mg and Si lower the melting point of the master-alloy powder and facilitate the liquid-phase sintering. Mg and Si cause precipitation hardening of the sintered aluminum-alloy. The content of Mg and Si must be 1% or more each, so as to attain the above described effects. The Mg and Si contents must be 20% or less each, because of the reasons described hereinabove related to the difficulties in melting and atomizing. The composition of the master-alloy powder for producing B alloy is therefore from 30 to 50% of Cu, from 1 to 20% of Si, from 1 to 20% of Mg, and Al and unavoidable impurities in balance, and is preferably, from 30 to 40% of Cu, from 1 to 10% of Si, from 1 to 10% of Mg, and Al and unavoidable impurities in balance.

The master-alloy powder according to the present invention may be the above described Al-Mg-Si or Al-Mg-Si-Cu alloy, which further contains one or more of from 0.1 to 8% of Mn, Ni, Fe, Cr, Zr, Ti, V, Pb, Bi, and Sn. The following kinds of master-alloy powder are therefore provided.

An inventive master-alloy powder according to the present invention is from 4 to 20% of Mg, from 12 to 30% of Si, from 0.1 to 8% of at least one element selected from the group consisting of Mn, Ni, Fe, Cr, Zr, Ti, V, Pb, Bi, and Sn. Another inventive master-alloy powder according to the present invention consists of from 4 to 20% of Mg, from 12 to 30% of Si, from 30 to 50% of Cu, from 0.1 to 8% of at least one element selected from the group consisting of Mn, Ni, Fe, Cr, Zr, Ti, V, Pb, Bi, and Sn. Another inventive master-alloy powder according to the present invention consists of from 30 to 50% of Cu, from 1 to 20% of Si, from 1 to 20% of Mg, from 0.1 to 8% of at least one element selected from the group consisting of Mn, Ni, Fe, Cr, Zr, Ti, V, Pb, Bi, and Sn. Each of these master-alloy powders is used for preparing a powder mixture which provide a sintered aluminum-alloy containing 4% or less in total of at least one element selected from the group consisting of Mn, Ni, Fe, Cr, Zr, Ti, V, Pb, Bi, and Sn.

The Mg, Si and Cu contents of the master-alloy powders are adjusted within the above mentioned ranges so as to effectively balance their effects in such powders. In addition, their contents are adjusted so as to attain a desirable temperature for the liquid-phase formation caused by the reaction between the master-alloy powders and the main starting-powder.

The above mentioned ranges of the Mg, Si, and Cu contents enable the mixing amount of a master-alloy powder to be set as described hereinafter.

If the mixing amount of the master-alloy powder is very small, a satisfactory amount of the liquid phase will not form, so that the mechanical properties of the sintered aluminum-alloy become poor. On the other hand, if the mixing amount of the master-alloy powder is too much, then, the compactibility of the powder mixture is impaired, and, the liquid phase is formed in such a great amount that the surface properties of the sintered product are impaired due to exudation. The mixing amount of a master-alloy powder is from 2 to 15%, preferably from 3 to 12%.

The composition and mixing amount of the master-alloy powder and the composition of the main starting-powder are determined together so as to attain the final composition, i.e., the composition of a sintered aluminum-alloy, taking into consideration the above described, function of the elements, and the respective powders.

When the starting powder mixture contains a large proportion of particles over 50 mesh, the powder filling in a die is impaired. On the other hand, when the starting powder-mixture contains a large proportion of particles under 635 mesh, fluidity of the powder is impaired, and, the particles penetrate into a clearance between the punch and the die to cause scoring. The particle size of the starting powder-mixture, i.e., the mixture of the master-alloy powder and main starting-powder, is, therefore, preferably under 50 mesh, with 90% or more of the particles over 635 mesh.

The starting powder-mixture may be preliminarily heated and annealed to soften the same and further enhance the compactibility.

A lubricant may be mixed with the starting powder-mixture to improve lubrication of the powder particles and lubrication of the powder and wall surfaces of a die. The lubricant can enhance the compactibility of the starting powder mixture. When the mixing amount of the lubricant is 0.2% or less, its effects are insufficient. On the other hand, when the mixing amount of the lubricant is 2% or more, not only has its effectiveness reached its limit, but also, the fluidity and compactibility of the starting powder-mixture are impaired. In addition, the lubricant vaporized during sintering scatters in the sintering furnace and contaminates the furnace interior and the gas-exhausting system in the case of sintering under vacuum. The mixing amount of lubricant is therefore between 0.2 and 2%, preferably between 0.7 and 1.8%. The kind of lubricant is preferably such one that totally vaporizes at a temperature below the sintering temperature and hence does not exert any detrimental influence upon the material properties of a sintered aluminum-alloy. From this point of view, an organic lubricant free of metal, or an amide-based lubricant, particularly, ethylene bisstearoamide, are more preferable than ametallic lubricant, such as zinc stearate, lithium stearate, of aluminum stearate.

The sintered product according to the present invention may further contain the following particles or fibers which are dispersed in the sintered aluminum-alloy as the second phase particles: ceramics which improve wear-resistance; metals which improve wear-resistance or; Si which improves wear-resistance and decreases thermal expansion; C (graphite or amorphous carbon) which decreases the coefficient of friction: and a solid lubricant which imparts to the sintered product lubricating property.

Method for Producing a Sintered Product

A starting powder-mixture having the desired alloy-composition is prepared and is compacted by compression. When the compacting pressure is less than 2 ton/cm$^2$, a green compact is not highly densified and the powder particles are not brought into thorough contact with each other. A sintered product so produced does not have excellent strength or elongation. The compacting pressure is therefore preferably 2 ton/cm$^2$ or more. On the other hand, when the compacting pressure is too high, the lamination of a green compact, scoring of a die, and reduction in life of a die occur. The preferred highest compression pressure is 8 ton/cm$^2$. Compacting is therefore preferably carried out at a pressure of from 2 to 8 ton/cm$^2$. The starting powder-mixture may be heated to a temperature of from 70° to 250° C. while compacting.

The sintering atmosphere must thoroughly prevent oxidation of the aluminum-alloy particles whose surface is active, thereby promoting sintering. The sintering atmosphere is therefore a vacuum or non-oxidizing, such as nitrogen gas- or argon gas-atmosphere. The degree of vacuum is preferably 0.1 torr or less or more preferably 0.01 torr or less. When the nitrogen or other inert atmosphere is to be used for sintering, the air in the sintering furnace is replaced with a vacuum, then nitrogen or inert gas is flown into the sintering furnace under reduced pressure. The flowing amount of the inert gas is very small. Gas in a green compact is withdrawn through the pores into the sintering atmosphere. The low pressure of the sintering atmosphere is effective for the gas removal. The purity of nitrogen and argon gases is important. Particularly, moisture contained in the gases exerts detrimental effects upon the properties of a sintered product. The dew point of the gases is therefore strictly controlled and is desirably −40° C. or lower.

When the sintering temperature is less than 500° C., it is too low to promote the diffusion which causes the sintering of the powder particles. On the other hand, when the sintering temperature is more than 650° C., the amount of liquid phase formed due to melting of the powder is too much to maintain the shape of a sintered product. The sintering temperature is therefore from 500° to 650° C.

A sintered product produced as described above may be subjected to re-compacting. An appropriate pressure for the re-compacting is from 3 to 11 ton/cm$^2$. The re-compacting has as an object the enhancement of the dimension accuracy of a sintered product. Such re-compacting is usually referred to as the sizing. The other object is enhancement of the mechanical properties. In the latter, pores of a sintered product are crushed and diminished, and the proportion of metallic contact at the particle surfaces is increased. The re-compacted sintered product has a high density. The recompression induces work-hardening which enhances the strength but decreases the elongation. When the re-compacted product is subsequently heat-treated, the work-hardening is eliminated, while diffusion and sintering are promoted to a degree. As a result, both strength and elongation are enhanced. According to an experiment by the present inventors, the re-compacting followed by heat treatment enhances strength by approximately 20 to 30% and enhances elongation approximately 1.4 to 4 times as high as that of a sintered product. The re-compacting and then heat-treating process is therefore very effective for enhancing the mechanical properties. Particularly, this process is advantageous for producing precision parts of industrial machines which are required to have good elongation properties.

It is possible to enhance the mechanical properties by re-sintering a re-compacted product. The re-sintering is effective for enhancing the mechanical properties, particularly elongation. Since the re-compacted structure is dense, the diffusion and sintering are effectively promoted. The re-sintering conditions, including the sintering temperature of from 500° to 600° C., are basically the same as th sintering conditions.

It is possible to subject a sintered aluminum-alloy, a sintered and then re-compacted aluminum-alloy, or a sintered, re-compacted, and then heat-treated aluminum-alloy to $T_6$ treatment or $T_4$ treatment (solution heat-treatment followed by aging). These treatments enhance the mechanical properties of aluminum-alloys, because Cu, Mg, and Si contained in the alloys strengthen the alloys when heat treated, as in the case of ordinary wrought aluminum-alloys. $T_6$ treatment is particularly effective for providing a high strength. The $T_6$ tempered Al—Cu alloy exhibits 35 kgf/mm$^2$ or more of tensile strength. T4 treatment is appropriate for obtaining mechanical properties with well balanced strength and elongation.

Regarding the sintered aluminum-alloys whose composition is similar or belongs to the 2000 series or 6000 series of AA standard, it is conventionally difficult to attain both high tensile strength and elongation, because diffusion and sintering are ineffective. Particularly elongation is poor in the conventional sintered aluminum-alloys.

According to the present invention, sintered A alloy with $T_4$ temper exhibits 19 kgf/mm$^2$ or more of tensile strength and 8% or more of elongation.

A sintered B alloy with $T_4$ temper exhibits 23 kgf/mm$^2$ or more of tensile strength and 2.5% or more of elongation.

A sintered A alloy with $T_6$ temper exhibits 22 kgf/mm$^2$ or more of tensile strength and 3% or more of elongation.

A sintered B alloy with $T_6$ temper exhibits 33 kgf/mm$^2$ or more of tensile strength and 1.5% or more of elongation.

A sintered and then re-compacted A alloy with $T_4$ temper exhibits 26 kgf/mm$^2$ or more of tensile strength and 20% or more of elongation.

A sintered and then re-compacted B alloy with $T_4$ temper exhibits 30 kgf/mm$^2$ or more of tensile strength and 7% or more of elongation.

A sintered and then re-compacted A alloy with $T_6$ temper exhibits 28 kgf/mm$^2$ or more of tensile strength and 8% or more of elongation.

A sintered and then re-compacted B alloy with $T_6$ temper exhibits 36 kgf/mm$^2$ or more of tensile strength and 2% or more of elongation.

A sintered, re-compacted and then re-sintered A alloy with $T_4$ temper exhibits 26 kgf/mm$^2$ or more of tensile strength and 22% or more of elongation.

A sintered, re-compacted and then re-sintered B alloy with $T_4$ temper exhibits 32 kgf/mm$^2$ or more of tensile strength and 9% or more of elongation.

A sintered, re-compacted and then re-sintered A alloy with $T_6$ temper exhibits 28 kgf/mm$^2$ or more of tensile strength and 9% or more of elongation.

A sintered, recompressed and then re-sintered B alloy with $T_6$ temper exhibits 38 kgf/mm$^2$ or more of tensile strength and 3% or more of elongation.

The present invention is hereinafter described with reference to the examples.

EXAMPLE 1

The main starting powders having compositions shown in Table 1, and the master-alloy powder having the composition shown in Table 2 were prepared by the air-atomizing method. They were sieved to provide powders under 100 mesh and over 325 mesh. They were then blended in the proportion shown in Table 3 to provide the starting powder-mixture, to which 1% of amide-based lubricant was then added. The so-prepared starting powder-mixture was compacted into a form of the tensile test specimen stipulated in JIS Z 2550 under the compacting pressure of 4 ton/cm$^2$. A green compact thus shaped was sintered at 570°-590° C. for 2 hours under nitrogen atmosphere with a reduced pressure of 1 to 3 torr. The sintered product was then subjected to $T_6$ or $T_4$ treatment. The tensile test was then carried out. The results are shown in Table 4.

Several of the sintered products were re-compacted at a pressure of 5 ton/cm$^2$ and then subjected to $T_6$ or $T_4$ treatment. The tensile test was then carried out. The results are shown in Table 4.

COMPARATIVE EXAMPLE 1

Al-4% Cu powder was prepared by the air-atomizing method and then sieved to provide powders under 100 mesh and over 325 mesh. This was then blended with Al-20% Si-10% Mg powder given in Table 2 in the proportions shown in Table 3 to provide a starting powder-mixture, to which 1% of amide-based lubricant was added. The so-prepared starting powder-mixture was subjected to production of a tensile-test specimen under the same conditions as in Example 1. The results are shown in Table 4.

COMPARATIVE EXAMPLE 2

Al powder was prepared by the air-atomizing method and then sieved to provide powders under 100 mesh and over 325 mesh. This was then blended with Al-20% Si-10% Cu-10% Mg powder or Al-6% Si-40% Cu-6% Cu powder, as given in Table 2, in a proportion shown in Table 3, to provide a starting powder-mixture, to which 1% of amide-based lubricant was then added. The so-prepared starting powder-mixture was subjected to production of a tensile-test specimen under the same conditions as in Example 1. The results are shown in Table 4.

COMPARATIVE EXAMPLE 3

Al powder was prepared by the air-atomizing method and then sieved to provide powders under 100 mesh and over 325 mesh. This was then blended with Si powder, Mg powder, and Cu powder, whose particle size was preliminarily adjusted under 100 mesh and over 325 mesh as well. These powders were blended to provide a composition of Al-1% Si-0.5% Cu-0.5% Mg, to which 1% of amide-based lubricant was then added.

The so-prepared starting powder-mixture was subjected to production of a tensile-test specimen under the same conditions as in Example 1. The results are shown in Table 4.

As is apparent from Table 4, the sintered and then $T_6$ treated A alloy exhibits from 22 to 25 kgf/mm$^2$ of tensile strength and 3% or more of elongation. The strength and elongation of this alloy are superior to those of the conventional sintered aluminum-alloys.

The sintered, re-compacted and then $T_6$ tempered A alloy exhibits from 28 to 33 kgf/mm$^2$ of tensile strength and 8% or more of elongation. The strength and elongation of this alloy are superior to those of the sintered and then $T_6$ tempered A alloy. In other words, the recompression enhances both the strength and elongation, without deteriorating either of the two properties.

The sintered, re-compacted and then T4 tempered A alloy exhibits from 26 to 29 kgf/mm$^2$ of tensile strength and 23% or more of elongation. This alloy is considerably ductile since the elongation is considerably higher than the heretofore known value.

The sintered and then $T_6$ tempered B alloy exhibits from 33 to 35 kgf/mm$^2$ of tensile strength and 1.5% or more of elongation. This is very high-strength alloy with an adequate ducility.

The sintered, re-compacted, and then $T_6$ tempered B alloy exhibits from 38 to 41 kgf/mm$^2$ of tensile strength and 2.4% or more of elongation. This is an extremely high-strength alloy with an improved ductility as compared with the sintered and then $T_6$ tempered aluminum-alloy.

The sintered, re-compacted, and then $T_4$ tempered B alloy exhibits 30 kgf/mm$^2$ or more of tensile strength and 8% or more of elongation. This is a ductile alloy with high strength.

In Comparative Example 1, since the Cu content of the main starting-powder is high, its compactibility is so poor that lamination occurred when forming a green compact.

In Comparative Example 2, since the pure Al powder is used for the main starting-powder, A alloy (No. 20) and B alloy (No. 21) exhibit both low strength and elongation. In Comparative Example 3, since alloying additives are used in elemental form, i.e., Si, Cu, and Mg, the strength and elongation obtained are very low.

TABLE 1

| | Symbols | Chemical composition Si | Cu | Mg | | Al |
|---|---|---|---|---|---|---|
| Examples | A1 | — | 0.25 | — | | Bal |
| | A2 | — | 0.5 | — | | Bal |
| | A3 | — | 1 | — | | Bal |
| | A4 | — | 1.5 | — | | Bal |
| | A5 | — | 2 | — | | Bal |
| | A6 | — | 2 | — | Mn 0.25 | Bal |
| Comparative Examples | A7 | — | 4 | — | | Bal |
| | A8 | — | — | — | | 100 |

TABLE 2

| | Symbols | Chemical composition Si | Cu | Mg | | Al |
|---|---|---|---|---|---|---|
| Al—Mg—Si | B1 | 15 | — | 5 | | Bal |
| Master | B2 | 20 | — | 10 | | Bal |
| Alloy | B3 | 25 | — | 15 | | Bal |
| (for A alloy) | | | | | | |
| Al—Mg—Si | B4 | 20 | 5 | 10 | | Bal |
| Master | B5 | 20 | 10 | 10 | | Bal |
| Alloy | B6 | 20 | 20 | 10 | | Bal |
| (for A alloy) | B7 | 25 | 15 | 15 | | Bal |
| Al—Mg—Si | B8 | 6 | 30 | 6 | | Bal |
| Mother | B9 | 12 | 30 | 12 | | Bal |
| Alloy | B12 | 3 | 40 | 3 | | Bal |
| (for B alloy) | B11 | 6 | 40 | 6 | | Bal |
| | B12 | 6 | 40 | 6 | Mn 5 | Bal |
| | B13 | 6 | 40 | 6 | Ni 10 | Bal |
| | B14 | 3 | 40 | 3 | Mn 2.5 | Bal |

TABLE 3

| | No. | Type of Main Starting-Powder | Type of Master-Alloy Powder | Blending Proportion (Weight Ratio) | Blending Composition Si | Cu | Mg | | Al |
|---|---|---|---|---|---|---|---|---|---|
| Example A alloy | 1 | A2 | B1 | 95:5 | 0.75 | 0.5 | 0.25 | | Bal |
| | 2 | A2 | B2 | 95:5 | 1.0 | 0.5 | 0.5 | | Bal |
| | 3 | A2 | B3 | 95:5 | 1.25 | 0.5 | 0.75 | | Bal |
| | 4 | A3 | B2 | 95:5 | 1.0 | 1.0 | 0.5 | | Bal |
| | 5 | A4 | B2 | 95:5 | 1.0 | 1.5 | 0.5 | | Bal |
| Example A alloy | 6 | A1 | B4 | 95:5 | 1.0 | 0.5 | 0.5 | | Bal |
| | 7 | A2 | B5 | 95:5 | 1.0 | 1.0 | 0.5 | | Bal |
| | 8 | A3 | B5 | 95:5 | 1.0 | 1.5 | 0.5 | | Bal |
| | 9 | A2 | B6 | 95:5 | 1.0 | 1.5 | 0.5 | | Bal |
| | 10 | A1 | B7 | 95:5 | 1.25 | 1.0 | 0.75 | | Bal |
| Example B alloy | 11 | A5 | B8 | 90:10 | 0.6 | 4.8 | 0.6 | | Bal |
| | 12 | A3 | B9 | 90:10 | 1.2 | 3.9 | 1.2 | | Bal |
| | 13 | A5 | B11 | 95:5 | 0.3 | 3.9 | 0.3 | | Bal |
| | 14 | A3 | B11 | 92.5:7.5 | 0.45 | 3.9 | 0.45 | | Bal |
| | 15 | A6 | B11 | 95:5 | 0.3 | 3.9 | 0.3 | Mn 0.24 | Bal |
| | 16 | A5 | B12 | 95:5 | 0.3 | 3.9 | 0.3 | Mn 0.25 | Bal |
| | 17 | A6 | B13 | 95:5 | 0.3 | 3.9 | 0.3 | Mn 0.24, Ni 0.5 | Bal |
| | 18 | A5 | B14 + Pure Mg powder | 94:5:1 | 0.15 | 3.9 | 1.15 | Mn 0.125 | Bal |
| Comparative Example 1 | 19 | A7 | B2 | 95:5 | 1.0 | 3.8 | 0.5 | | Bal |
| Comparative Example 2 | 20 | A8 | B5 | 95:5 | 1.0 | 0.5 | 0.5 | | Bal |
| | 21 | A8 | B11 | 90:10 | 0.3 | 4.0 | 0.3 | | Bal |
| Comparative Example 3 | 22 | A8 | Si, Cu, Mg Elemental powder | | 1.0 | 1.0 | 0.5 | | Bal |

TABLE 4

| | No. | Sintering + $T_6$ Tensile Strength (kgf/mm$^2$) | 0.2% proof Strength (kgf/mm$^2$) | Elongation (%) |
|---|---|---|---|---|
| Example | 1 | 22.0 | 19.6 | 4.1 |

TABLE 4-continued

| | | | | |
|---|---|---|---|---|
| A alloy | 2 | 23.0 | 20.7 | 3.9 |
| | 3 | 25.1 | 22.7 | 3.8 |
| | 4 | 24.4 | 22.0 | 3.5 |
| | 5 | 25.1 | 23.3 | 3.5 |
| Example | 6 | 22.6 | 20.0 | 3.9 |
| A alloy | 7 | 23.9 | 21.0 | 3.8 |
| | 8 | 25.6 | 20.5 | 3.0 |
| | 9 | 24.8 | 21.7 | 3.0 |
| | 10 | 22.8 | 20.8 | 3.1 |
| Example | 11 | 34.9 | 31.0 | 1.7 |
| B alloy | 12 | 34.2 | 31.8 | 1.6 |
| | 13 | 33.8 | 30.7 | 2.7 |
| | 14 | 33.1 | 30.5 | 2.5 |
| | 15 | — | — | — |
| | 16 | — | — | — |
| | 17 | — | — | — |
| | 18 | — | — | — |
| Comparative Example 1 | 19 | Green compact could not be obtained because of lamination | | |
| Comparative | 20 | 21.5 | 20.2 | 3.1 |
| Example 2 | 21 | 33.0 | 31.9 | 0.8 |
| Comparative Example 3 | 22 | 19.9 | 17.1 | 0.5 |

| | | Sintering + $T_4$ | | |
|---|---|---|---|---|
| | No. | Tensile Strength (kgf/mm$^2$) | 0.2% proof Strength (kgf/mm$^2$) | Elongation (%) |
| Example | 1 | — | — | — |
| A alloy | 2 | 19.8 | 11.9 | 6.2 |
| | 3 | — | — | — |
| | 4 | 21.5 | 12.5 | 5.4 |
| | 5 | 22.4 | 13.9 | 6.8 |
| Example | 6 | — | — | — |
| A alloy | 7 | 20.9 | 12.5 | 7.2 |
| | 8 | 22.8 | 14.2 | 8.0 |
| | 9 | 22.3 | 14.6 | 7.2 |
| | 10 | — | — | — |
| Example | 11 | — | — | — |
| B alloy | 12 | — | — | — |
| | 13 | — | — | — |
| | 14 | — | — | — |
| | 15 | — | — | — |
| | 16 | — | — | — |
| | 17 | — | — | — |
| | 18 | — | — | — |
| Comparative Example 1 | 19 | Green compact could not be obtained because of lamination | | |
| Comparative | 20 | 15.9 | 10.9 | 7.2 |
| Example 2 | 21 | 28.7 | 20.9 | 4.6 |
| Comparative Example 3 | 22 | — | — | — |

| | | Re-compacting + $T_6$ | | |
|---|---|---|---|---|
| | No. | Tensile Strength (kgf/mm$^2$) | 0.2% proof Strength (kgf/mm$^2$) | Elongation (%) |
| Example | 1 | 28.5 | 22.2 | 12.1 |
| A alloy | 2 | 29.8 | 26.1 | 10.9 |
| | 3 | 32.0 | 25.5 | 11.0 |
| | 4 | 32.5 | 26.0 | 10.3 |
| | 5 | 31.9 | 24.6 | 10.1 |
| Example | 6 | — | — | — |
| A alloy | 7 | 30.6 | 23.9 | 10.4 |
| | 8 | 31.2 | 25.5 | 8.9 |
| | 9 | 30.8 | 25.5 | 11.5 |
| | 10 | — | — | — |
| Example | 11 | 40.4 | 37.8 | 2.4 |
| B alloy | 12 | 40.2 | 38.0 | 2.5 |
| | 13 | 38.8 | 36.5 | 4.8 |
| | 14 | 39.2 | 37.0 | 4.9 |
| | 15 | 40.0 | 36.5 | 3.0 |
| | 16 | 40.4 | 36.9 | 4.5 |
| | 17 | 41.0 | 38.6 | 2.8 |
| | 18 | 39.6 | 38.0 | 2.6 |
| Comparative Example 1 | 19 | Green compact could not be obtained because of lamination | | |
| Comparative | 20 | 30.2 | 27.5 | 3.3 |
| Example 2 | 21 | 35.6 | 32.8 | 2.0 |
| Comparative Example 3 | 22 | 21.0 | 18.8 | 1.0 |

TABLE 4-continued

| | | Re-compacting + $T_4$ | | |
|---|---|---|---|---|
| | No. | Tensile Strength (kgf/mm$^2$) | 0.2% proof Strength (kgf/mm$^2$) | Elongation (%) |
| Example | 1 | — | — | — |
| A alloy | 2 | 26.5 | 14.4 | 25.0 |
| | 3 | — | — | — |
| | 4 | 29.3 | 15.0 | 23.1 |
| | 5 | 28.4 | 14.1 | 26.9 |
| Example | 6 | — | — | — |
| A alloy | 7 | 26.4 | 12.9 | 27.5 |
| | 8 | 28.5 | 14.5 | 25.9 |
| | 9 | 27.1 | 13.8 | 26.8 |
| | 10 | — | — | — |
| Example | 11 | 32.7 | 22.3 | 8.8 |
| B alloy | 12 | 32.4 | 22.3 | 9.1 |
| | 13 | 30.0 | 19.5 | 9.6 |
| | 14 | 33.1 | 21.5 | 10.1 |
| | 15 | — | — | — |
| | 16 | 34.2 | 20.8 | 15.0 |
| | 17 | — | — | — |
| | 18 | — | — | — |
| Comparative Example 1 | 19 | Green compact could not be obtained because of lamination | | |
| Comparative | 20 | 20.1 | 12.8 | 8.9 |
| Example 2 | 21 | 28.5 | 20.8 | 6.4 |
| Comparative Example 3 | 22 | — | — | — |

We claim:

1. A method for producing a sintered aluminum-alloy comprising compressing a mixed, aluminum-alloy starting powder which consists of a mixture of a first aluminum-alloy starting powder consisting of from 0.1 to 3.0% by weight of Cu and Al and unavoidable impurities in balance, and at least one second aluminum-alloy starting powder selected from (1) a aluminum alloy starting powder consisting of from 4 to 20% by weight of Mg, from 12 to 30% by weight of Si, and Al and unavoidable impurities in balance, and (2) an aluminum-alloy starting powder consisting of from 0.1 to 20.0% by weight of Mg, from 1 to 20% by weight of Si, from 30 to 50% by weight of Cu, and Al and unavoidable impurities in balance, in such an amount that a composition of the mixture is from 0.1 to 2.0% by weight of Mg, from 0.1 to 2.0% by weight of Si, from 0.2 to 6% by weight of Cu, and Al and unavoidable impurities in balance, said compressing being at a pressure of from 2 to 8 ton/cm$^2$ and then sintering the compress powder in a vacuum or inert atmosphere.

2. A method according to claim 1, wherein said mixed, aluminum-alloy starting powder has a temperature of from 70° to 250° C. during the compacting.

3. A method according to claim 1, wherein the sintering temperature is from 500° to 650° C.

4. A method according to claim 1, wherein a sintered alloy is subjected to re-compacting to produce a recompacted product.

5. A method according to claim 4, wherein the recompacting pressure is from 3 to 11 ton/cm$^2$.

6. A method according to claim 5, wherein the recompacted product is further subjected to a re-sintering.

7. A method for producing a sintered aluminum-alloy comprising compressing a mixed, aluminum-alloy starting powder which consists of a mixture of a first aluminum-alloy starting powder consisting of from 0.1 to 3.0% by weight of Cu and Al and unavoidable impurities in balance, and a second aluminum-alloy powder which consists of from 4 to 20% by weight of Mg, from 12 to 30% by weight of Si, from 1 to 30% by weight of Cu, and Al and unavoidable impurities in balance, said mixture having a composition of from 0.1 to 2.0% by weight of Mg, from 0.1 to 2.0% by weight of Si, from 0.2 to 6% by weight of Cu, and Al and unavoidable impurities in balance, said compressing being at a pressure of from 2 to 8 ton/cm$^2$ and then sintering the compressed powder in a vacuum or inert atmosphere.

8. A method according to claim 7, wherein said mixed, aluminum-alloy starting powder has a temperature of from 70° to 250° C. during the compacting.

9. A method according to claim 7, wherein the sintering temperature is from 500° to 650° C.

10. A method according to claim 7, wherein a sintered product is subjected to re-compacting to produce a re-compacted product.

11. A method according to claim 10, wherein the re-compacting pressure is from 3 to 11 ton/cm$^2$.

12. A method according to claim 11, wherein the re-compacted product is further subjected to a re-sintering.

13. A method for producing a sintered aluminum-alloy which consists of 0.1 to 2.0% by weight of Mg, from 0.1 to 2.0% by weight of Si, from 0.2 to 6% by weight Cu, and from 0.0 to 2.0% by weight of at least one element selected from the group consisting of Mn, Ni, Fe, Cr, Zr, Ti, V, Pb, Bi, and Sn, and, Al and unavoidable impurities in balance, comprising compressing a mixed, aluminum-alloy starting powder which consists of a mixture of a first aluminum-alloy starting powder containing from 0.1 to 3.0% be weight of Cu and by essential absence of Si and Mg, the balance being Al, an inclusion of said at least one element as well as unavoidable impurities, and from 2 to 15% by weight of at least one second aluminum-alloy starting powder selected from (1) an aluminum alloy starting powder consisting of from 4 to 20% by weight of Mg, from 12 to 30% by weight of Si, and Al and unavoidable impurities in balance, and (2) an aluminum-alloy starting powder consisting of from 0.1 to 20.0% be weight of Mg, from 1 to 20% by weight of Si, from 30 to 50% by weight of Cu, and Al and unavoidable impurities in balance, in such amounts that a composition of the mixture is from 0.1 to 2.0% by weight of Mg, from 0.1 to 2.0% by weight of Si, from 0.2 to 6% by weight Cu, and Al and unavoidable impurities in balance, said compression being from 2 to 8 ton/cm$^2$, and, then sintering the compressed powder in a vacuum or inert gas and at a temperature higher than a melting point of the aluminum-alloy starting powder (1) or the aluminum-alloy starting powder (2) and lower than the solidus temperature of the first aluminum-alloy starting powder.

14. A method according to claim 13, wherein said mixed, aluminum-alloy starting powder has a temperature of from 70° to 250° C. during the compacting.

15. A method according to claim 13, wherein the sintering temperature is from 500° to 650° C.

16. A method according to claim 13, wherein a sintered alloy is subjected to re-compacting to produce a recompacted product.

17. A method according to claim 16, wherein the re-compacting pressure is from 3 to 11 ton/cm$^2$.

18. A method according to claim 17, wherein the re-compacted product is further subjected to a re-sintering.

* * * * *